US012759775B2

(12) United States Patent
Hsu

(10) Patent No.: US 12,759,775 B2
(45) Date of Patent: Oct. 13, 2026

(54) SEALED CONTAINER LID

(71) Applicant: DRYTECH CORPORATION LTD., Tainan City (TW)

(72) Inventor: Tsang-Hung Hsu, Tainan City (TW)

(73) Assignee: DRYTECH CORPORATION LTD., Tainan City (TW)

( * ) Notice: Subject to any disclaimer, the term of this patent is extended or adjusted under 35 U.S.C. 154(b) by 0 days.

(21) Appl. No.: 19/000,908

(22) Filed: Dec. 24, 2024

(65) Prior Publication Data

US 2026/0176037 A1 Jun. 25, 2026

(51) Int. Cl.
*B65D 51/30* (2006.01)
*B65D 51/24* (2006.01)

(52) U.S. Cl.
CPC ..... *B65D 51/30* (2013.01); *B65D 51/248* (2013.01); *B65D 2203/02* (2013.01)

(58) Field of Classification Search
CPC .... B65D 81/266; B65D 81/268; B65D 51/30; B65D 51/245; B65D 2203/02; B65D 51/248; B65D 43/164; B65D 41/0421
USPC ..... 206/204; 312/31.1; 215/344
See application file for complete search history.

(56) References Cited

U.S. PATENT DOCUMENTS 3,944,104 A * 3/1976 Watson ..... B65D 41/0421 215/354
7,591,369 B2 * 9/2009 Lin ..... A63B 67/18 239/57
7,742,360 B1 * 6/2010 Price ..... G09F 11/23 368/10
8,757,369 B2 * 6/2014 Portier ..... B65D 51/30 206/204
9,750,811 B2 * 9/2017 Egberg ..... A23B 2/771
10,279,966 B1 * 5/2019 Solomon ..... B65D 85/505
12,503,283 B1 * 12/2025 Vovan ..... B65D 50/048
2010/0044252 A1 * 2/2010 Portier ..... B65D 51/30 206/204
2015/0259115 A1 * 9/2015 Yeh ..... B65D 51/30 220/521
2023/0124358 A1 * 4/2023 Grossetete ..... B65D 43/162 206/204

FOREIGN PATENT DOCUMENTS

CN 117775500 B * 5/2024 ..... B29C 65/56
EP 4534436 A1 * 4/2025 ..... B65D 41/32
JP 2014218272 A * 11/2014 ..... B65D 51/28

* cited by examiner

*Primary Examiner* — Chun Hoi Cheung
(74) *Attorney, Agent, or Firm* — Rosenberg, Klein & Lee

(57) ABSTRACT

A sealed container lid is provided. A lid of a sealed container is provided with an open mounting recess and a one-piece moisture absorbing block is detachably mounted in the mounting recess of the lid directly. Without outer packaging, the moisture absorbing block has a large contact area with air and moisture in the sealed container is absorbed more effectively. Moreover, at least one circular deformable airtight ring is integrally formed on a surface of the lid in contact with an end surface of an opening of a container body. The deformable airtight ring is deformed due to pressure generated during fastening and thus closely attached to the end surface of the opening of the container body to form a tight seal ring. Therefore, multiple airtight seal between the lid and the container body is provided.

4 Claims, 10 Drawing Sheets

SEALED CONTAINER LID

BACKGROUND OF THE INVENTION

Field of the Invention

The present invention relates to a lid, especially to a sealed container lid for preserving food freshness.

Description of Related Art

A sealed container creates a relatively dry environment to keep food freshness or objects. The sealed container available now includes a container body and a detachable lid arranged at an opening on an upper part of the container body. An airtight washer is disposed on a junction between the lid and the opening of the container body to prevent moisture outside from entering the sealed container. The sealed container can preserve the objects in a sealed manner. However, the lid is open or closed while in use so that moisture outside may still enter the sealed container. Thus food preservation or object storage is affected because there is no difference between the moisture outside and the moisture in the sealed container. The sealed container available now doesn't have moisture-indicating function.

Moreover, the conventional sealed container has a shortcoming of insufficient sealing so that air is flowing into the sealed container easily. Thereby freshness and quality of food in the sealed container are further affected. Thus there is room for improvement and there is a need to provide a novel sealed container able to improve the shortcomings of the conventional sealed container.

SUMMARY OF THE INVENTION

Therefore, it is a primary object of the present invention to provide a sealed container lid in which a one-piece moisture absorbing block is directly mounted in an open mounting recess of a lid or taken out of the mounting recess of the lid to be heated for regeneration. There is no need to pack moisture absorbing material by packaging material and then mounted into a covered slot. The moisture absorbing block is easy to be put in or taken out of the mounting recess and having a larger air-contact area. Thereby moisture removal from an internal space of the sealed container is improved.

It is another object of the present invention to provide a sealed container lid which improves sealing performance between a lid and a container body. Thereby a good airtight seal is provided to extend food shelf life when the lid is fastened firmly on the container body.

In order to achieve the above objects, a sealed container lid includes a lid and a one-piece moisture absorbing block disposed on the lid. The moisture absorbing block is made from common moisture absorbing material ground into powder and mixed with resin. A mixture of the powder and the resin is treated by high temperature molding, then baked and cured to form a one-piece block. An open mounting recess is arranged at a lower surface of an end surface of the lid and a plurality of holding members is projecting from a surface of a peripheral wall of the mounting recess toward a center of the mounting recess. The moisture absorbing block is a one-piece block. In a state that the one-piece moisture absorbing block is mounted in the mounting recess, the holding members can hold the moisture absorbing block so that the moisture absorbing block is fixed in the open mounting recess.

An elastic ring is mounted to a circumferential surface of the moisture absorbing block.

An upper part and/or a lower part of the elastic ring are/is provided with a radially-projecting locking ring.

The holding member is a projecting piece and a locking portion is disposed on an end of the holding member and projecting toward the center of the mounting recess.

A shallow slot is mounted to an upper surface of the end surface of the lid and covered with a cover plate. Humidity-sensitive color-changing material is mounted in a space defined by the shallow slot and the cover plate. A plurality of holes is disposed on the end surface of the lid, penetrating the end surface, and corresponding to the shallow slot. The mounting recess is communicating with the shallow slot through the holes.

A date label member is mounted to the upper surface of the end surface of the lid.

The date label member consists of a month-label area, a day-label area, a month indicator, and a day indicator. The month-label area and the day-label area are respectively marked with numbers 1-12 and numbers 1-31. The month indicator and the day indicator are respectively provided with a month window and a day window. The month indicator is moveable within a range of the month-label area and one of the numbers 1-12 on the month-label area is selected by the month window. The day indicator is moveable within a range of the day-label area and one of the numbers 1-31 on the day-label area is selected by the day window.

At least one circular deformable airtight ring is integrally formed on a surface of the lid and the surface of the lid is in contact with an end surface of the container body correspondingly. Under a state that the lid and the container body are fastened with each other, the circular deformable airtight ring is deformed due to pressure generated during fastening and thus closely attached to the end surface of the container body to form a seal.

The circular deformable airtight ring is a circular angular ring with angular protrusions projecting from the lid toward the end surface of the container body.

The present invention has the following advantages.

By the one-piece design, the moisture absorbing block is directly mounted in the open mounting recess of the lid and having a large contact area with air to increase removal of moisture in the sealed container. There is no need to pack conventional granular moisture absorbing material in a packaging material for being mounted to the lid. The moisture absorbing efficiency of the conventional granular moisture absorbing material is reduced due to the packaging material.

Moreover, the one-piece moisture absorbing block is mounted and locked in the open mounting recess of the lid. Thus operations such as taking the one-piece moisture absorbing block out of the lid to heat for regeneration and mounting the regenerated one-piece moisture absorbing block directly into the open mounting recess of the lid are quite easy and convenient. There is no need to open the covered slot for taking out the moisture absorbing material.

Furthermore, the moisture inside the sealed container can be shown by the lid. Users can learn the state of the moisture absorbing block shown on the surface of the lid and take out the moisture absorbing block to heat for regeneration timely. Thereby a dry internal space of the sealed container is ensured.

By the design of the circular angular ring with angular protrusions, the sealed container has better sealing performance and easier operation. The user can seal the container body easily so that food freshness is retained and food waste is reduced.

DETAILED DESCRIPTION OF THE PREFERRED EMBODIMENT

Figure 1:
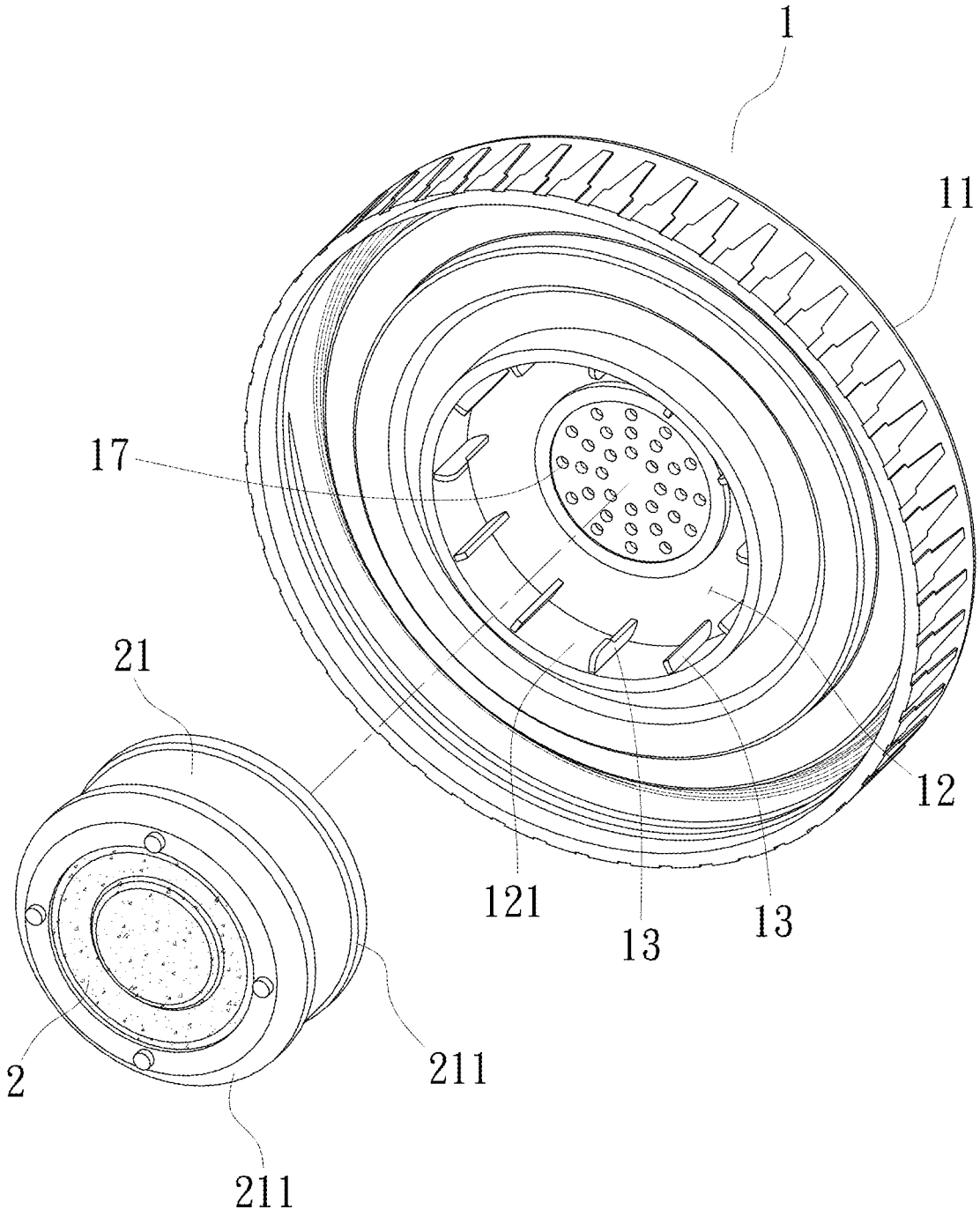
FIG. 1 is an exploded view showing a lid and a moisture absorbing block of an embodiment according to the present invention.
Figure 2:
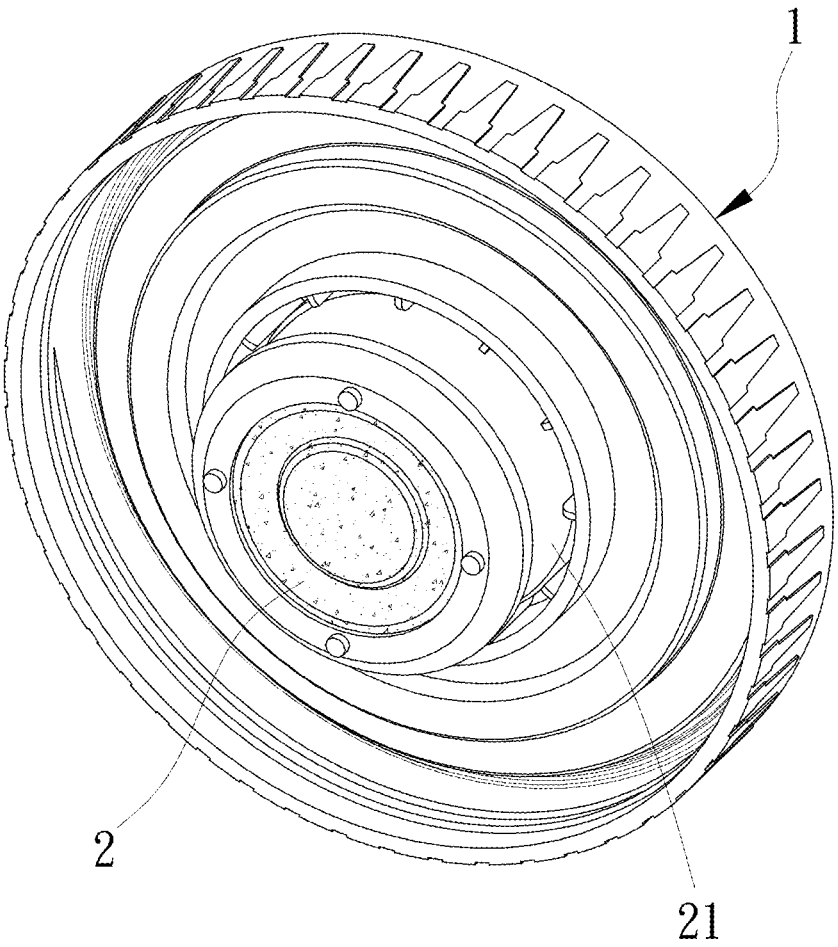
FIG. 2 is a perspective view of an embodiment according to the present invention.
Figure 3:
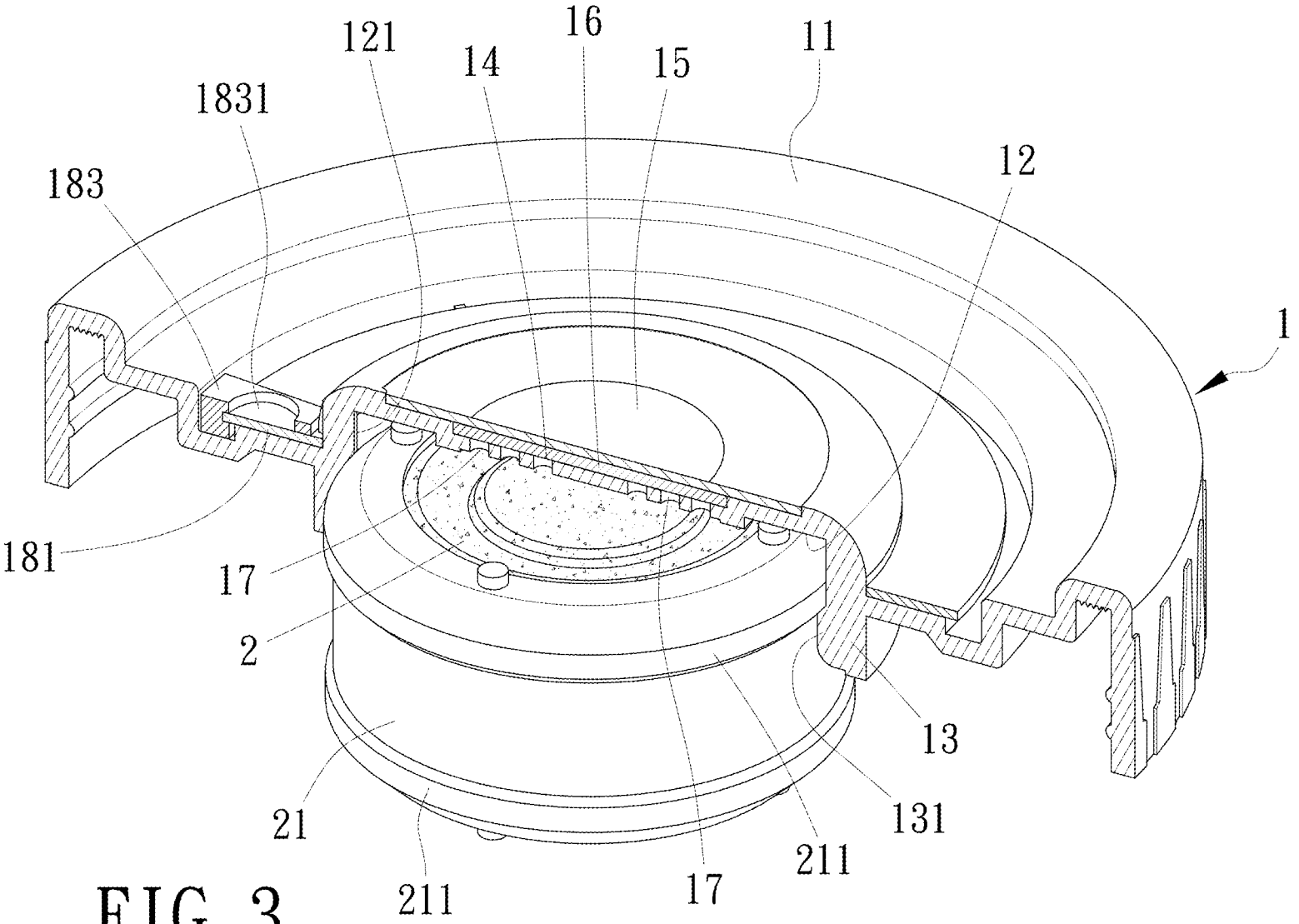
FIG. 3 is a front perspective sectional view showing a lid and a moisture absorbing block of an embodiment according to the present invention.
Figure 4:
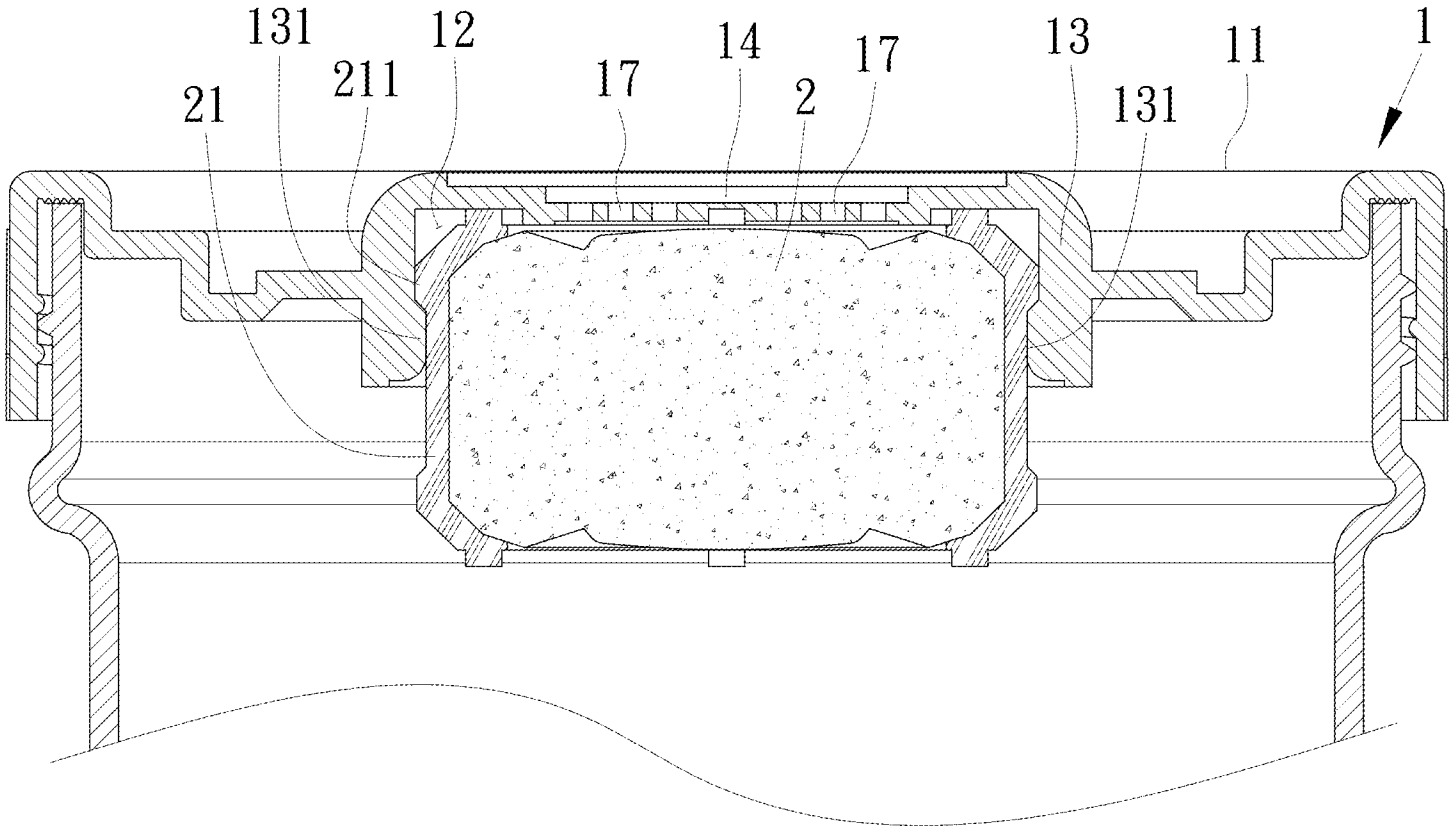
FIG. 4 is a side sectional view showing a lid and a moisture absorbing block of an embodiment according to the present invention.

Refer to FIGS. 1-4, a sealed container lid according to the present invention includes a lid 1 and a moisture absorbing block 2. The moisture absorbing block 2 is a one-piece block made from conventional moisture absorbing material ground into powder and mixed with resin. A mixture of the powder and the resin is processed by high temperature molding in a mold, then baked and cured to form the on-piece block. The moisture absorbing block 2 is disposed on the lid 1.

In a preferred embodiment, the lid 1 consists of an end surface 11, an open mounting recess 12 arranged at a lower surface of the end surface 11, a plurality of holding members 13 projecting from a surface of a peripheral wall 121 of the mounting recess 12 toward a center of the mounting recess 12. The moisture absorbing block 2 is a one-piece block. In a state that the one-piece moisture absorbing block 2 is mounted in the mounting recess 12, the holding members 13 can hold the moisture absorbing block 2 so that the moisture absorbing block 2 is fixed in the mounting recess 12.

Figure 6:
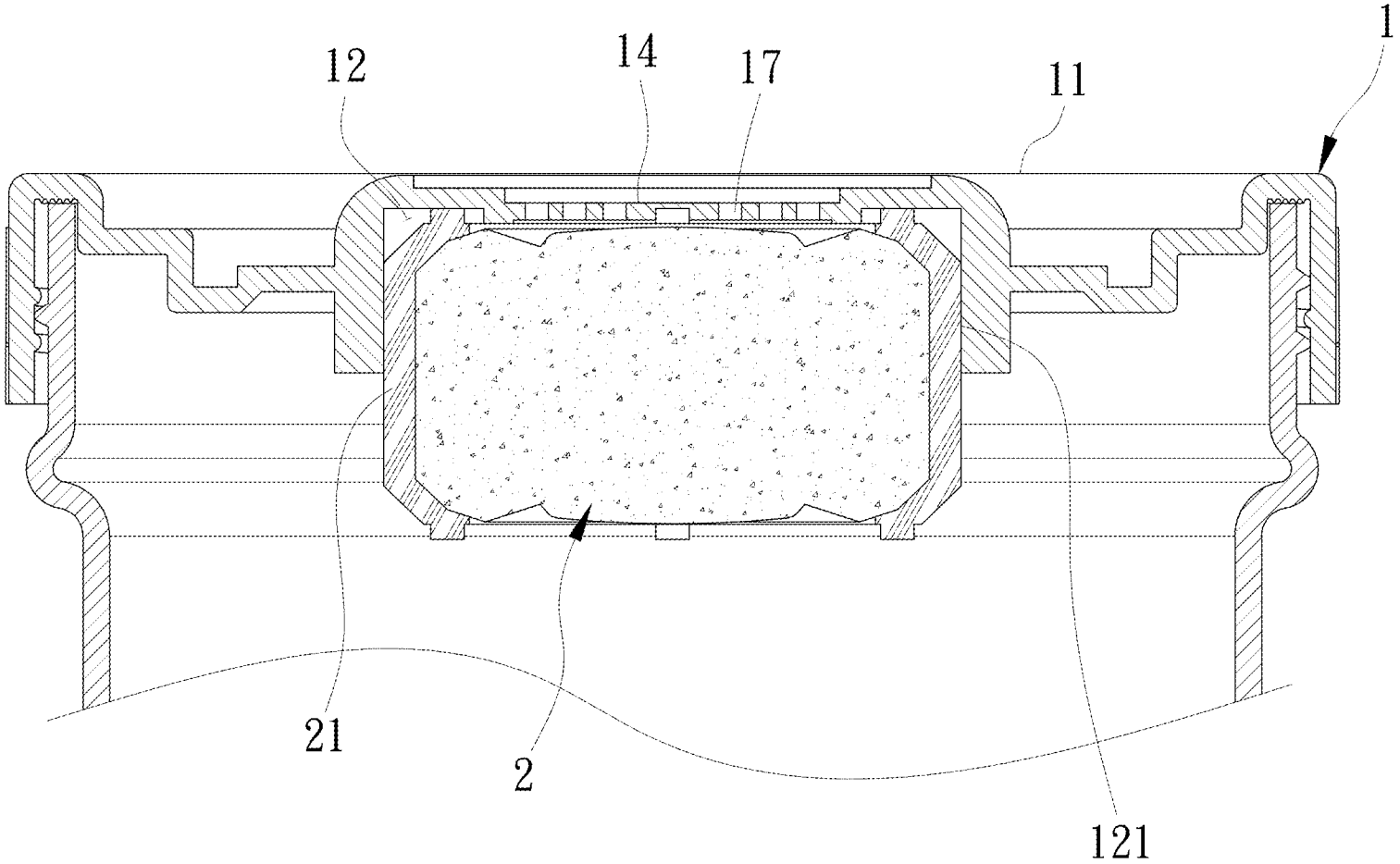
FIG. 6 is a side sectional view showing a lid and a moisture absorbing block of an embodiment according to the present invention.
Figure 7:
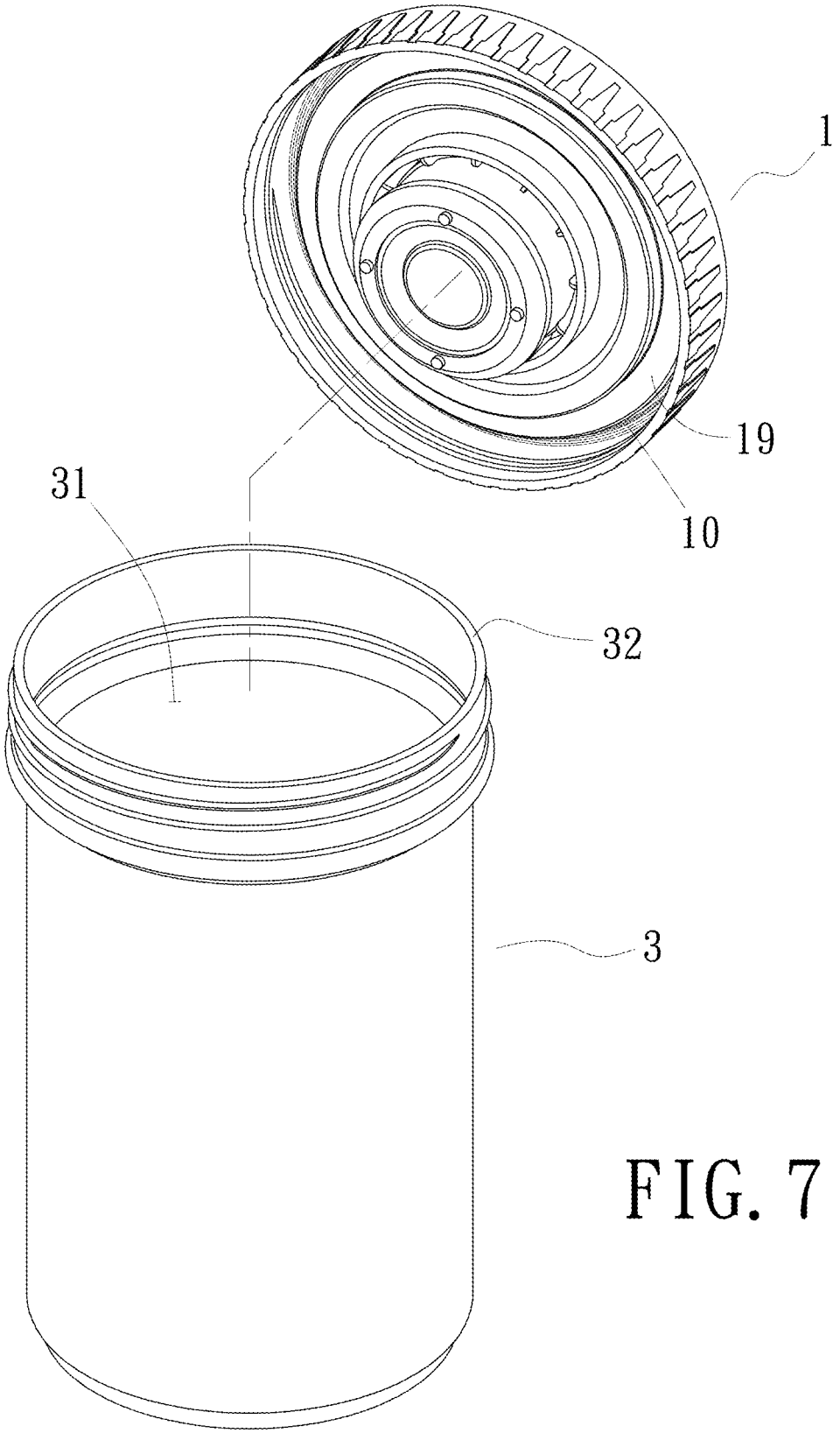
FIG. 7 is an exploded view showing a lid and a container body of a sealed container of an embodiment according to the present invention.
Figure 8:
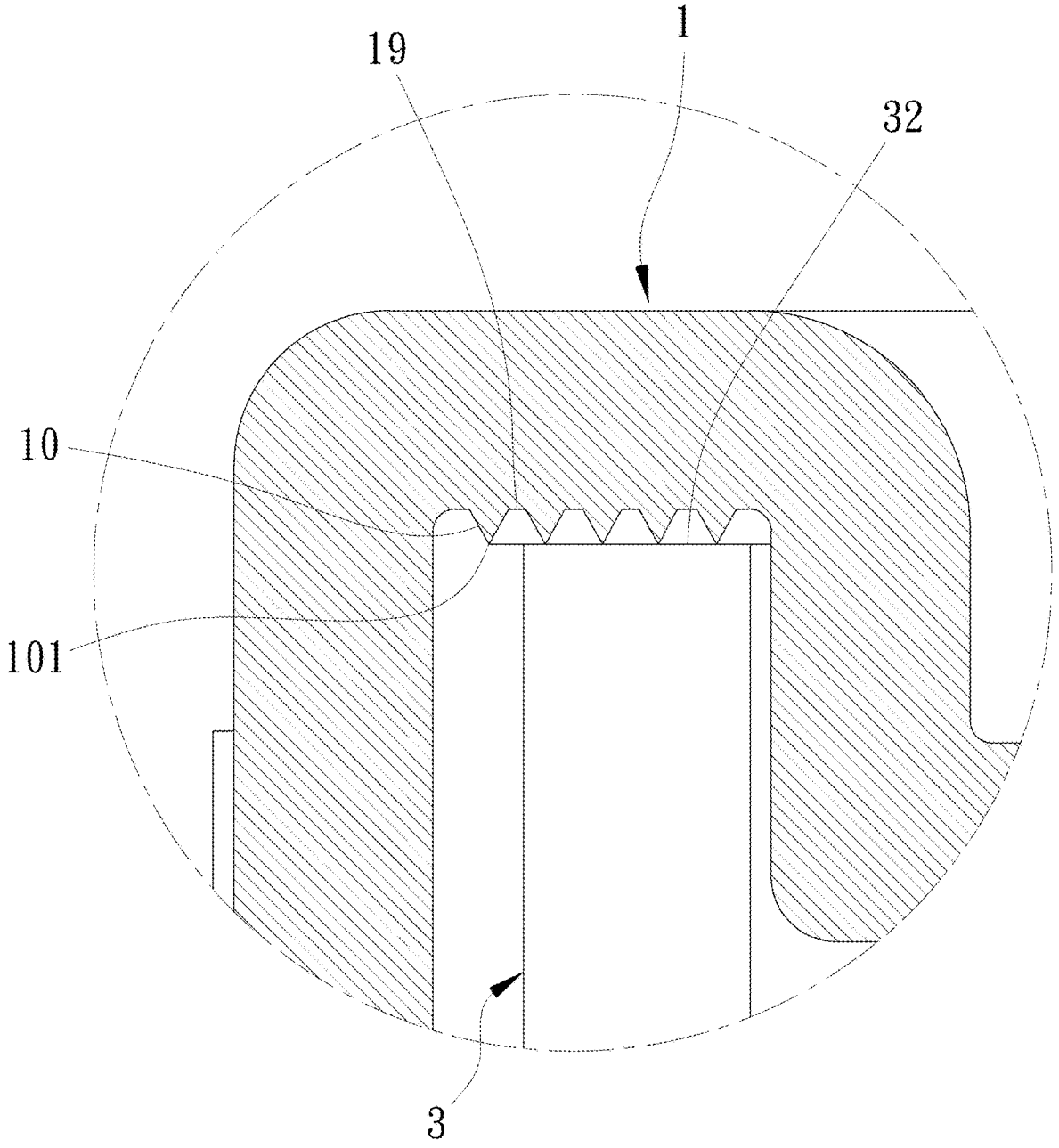
FIG. 8 is a schematic drawing showing an end surface of an opening of a container body of a sealed container and a circular deformable airtight ring of a lid corresponding to each other of an embodiment according to the present invention.
Figure 9:
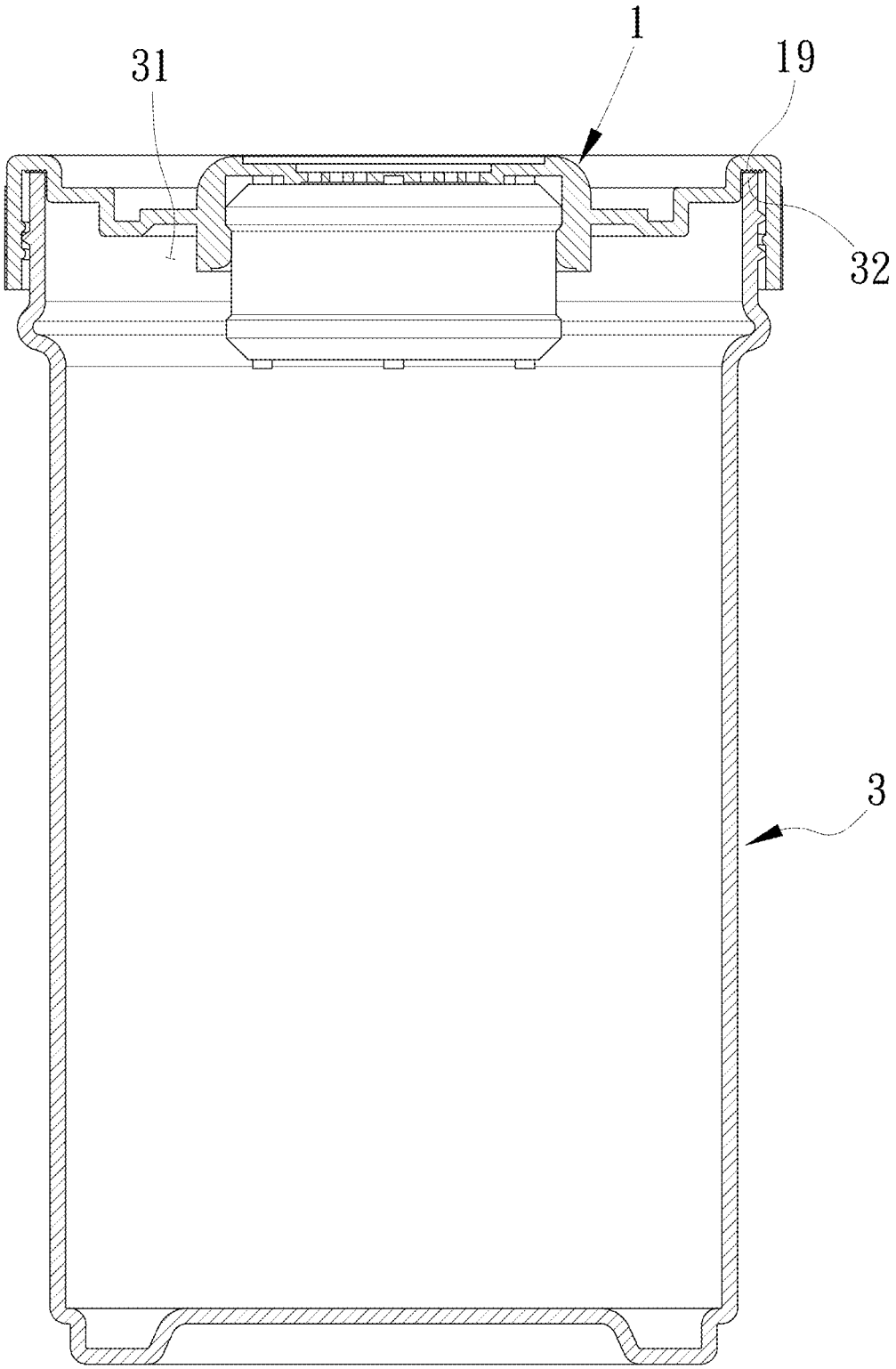
FIG. 9 is a sectional view showing a lid and a container body of a sealed container of an embodiment according to the present invention.
Figure 10:
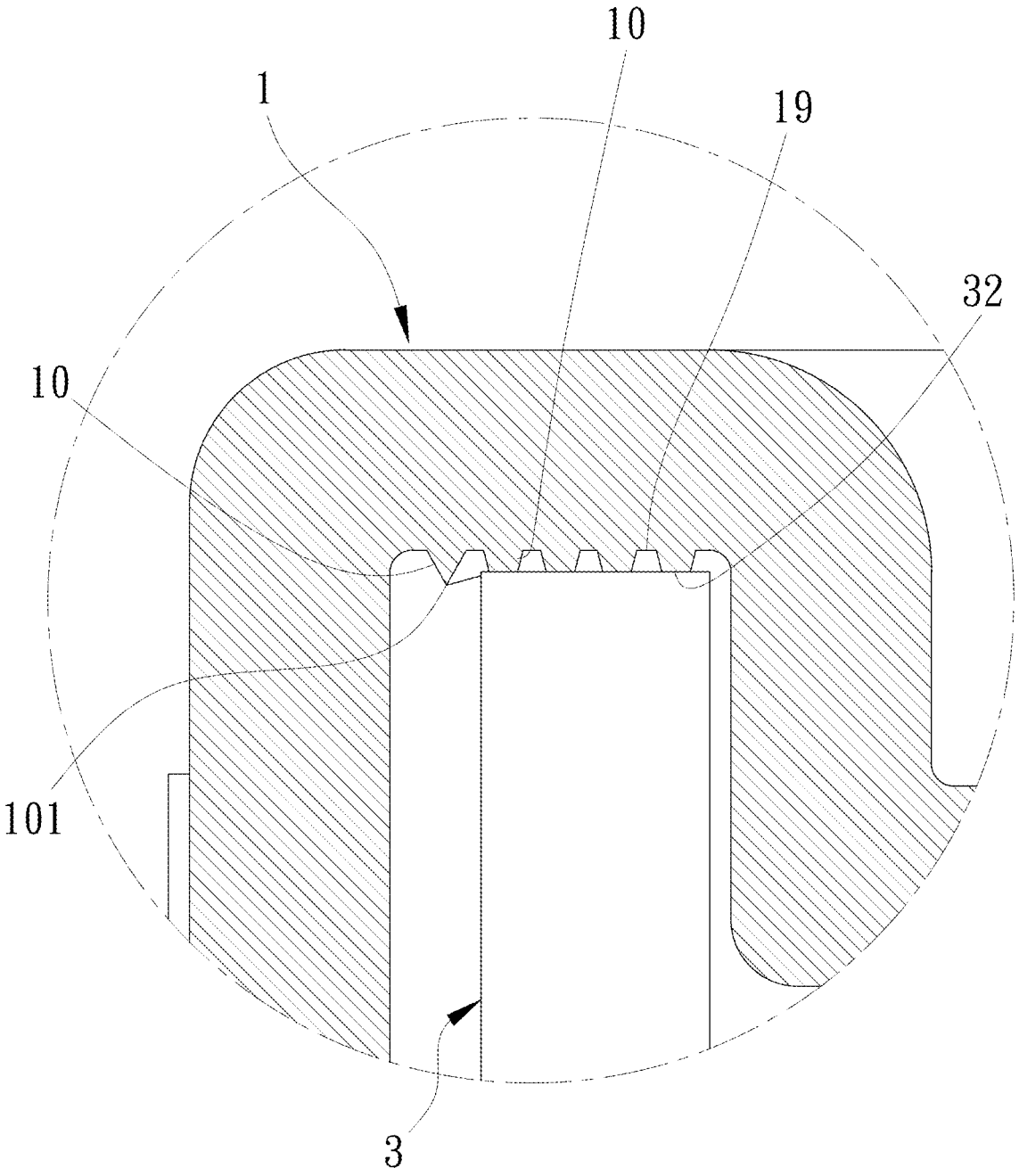
FIG. 10 is a schematic drawing showing deformation of a circular deformable airtight ring of a lid pressed by and closely attached to an end surface of an opening of a container body of an embodiment according to the present invention.

As shown in FIG. 6, an open mounting recess 12 is disposed on the lower surface of the end surface 11 of the lid 1 and the one-piece moisture absorbing block 2 is mounted in the mounting recess 12 directly. By suitable tightness and matching between the peripheral wall 121 of the mounting recess 12 and a circumferential surface of the moisture absorbing block 2, the moisture absorbing block 2 can also be positioned in the mounting recess 12.

Still refer from FIG. 1-4, in a preferred embodiment, an elastic ring 21 is mounted to the circumferential surface of the moisture absorbing block 2 for increasing a friction between the moisture absorbing block 2 and the peripheral wall 121 of the mounting recess 12 or a friction between the moisture absorbing block 2 and the holding members 13.

In a preferred embodiment of the present invention, an upper part and/or a lower part of the elastic ring 21 are/is provided with a radially-projecting locking ring 211 which is able to interact with the holding members 13 for elastically holding and locking each other. Thus the moisture absorbing block 2 is mounted to the lid 1 more securely.

In a preferred embodiment of the present invention, the holding member 13 is a projecting piece and a locking portion 131 is disposed on an end of a part or whole of the holding member 13 and projecting toward the center of the mounting recess 12. Thereby the moisture absorbing block 2 is mounted to the lid 1 more stably by the locking portion 131 locked with the locking ring 211 correspondingly.

In a preferred embodiment of the present invention, a shallow slot 14 is arranged at an upper surface of the end surface 11 of the lid 1 and covered with a cover plate 15 correspondingly. Humidity-sensitive color-changing material 16 is mounted in a space defined by the shallow slot 14 and the cover plate 15. A plurality of holes 17 is disposed on the end surface 11 of the lid 1, penetrating the end surface 11, and located at positions corresponding to the shallow slot 14. The mounting recess 12 is communicating with the shallow slot 14 through the holes 17. When the moisture absorbing block 2 is saturated after absorbing moisture, moisture inside the sealed container can pass through the holes 17 to be absorbed by the humidity-sensitive color-changing material 16 which changes color due to the moisture absorbed. Users can observe color change of the humidity-sensitive color-changing material 16 on the end surface 11 of the lid 1 to learn that the moisture absorbing block 2 is in the saturated state and heating is required to regenerate the moisture absorbing block 2.

Figure 5:
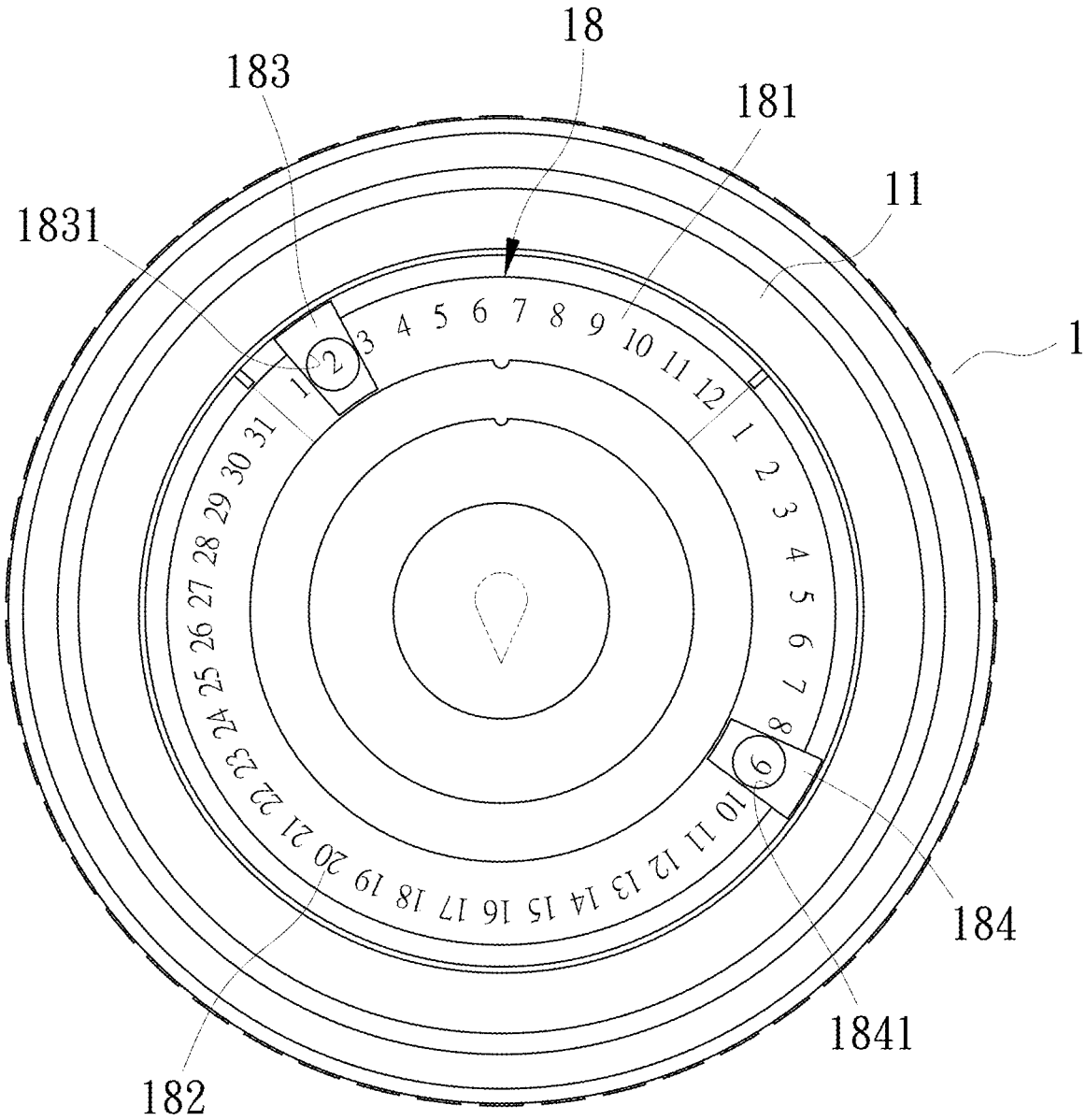
FIG. 5 is a top view of a lid of an embodiment according to the present invention.

Refer to FIG. 5, in a preferred embodiment, a date label member 18 is mounted to the upper surface of the end surface 11. The date label member 18 consists of a month-label area 181, a day-label area 182, a month indicator 183, and a day indicator 184. The month-label area 181 and the day-label area 182 are respectively marked with numbers 1-12 and numbers 1-31. The month indicator 183 and the day indicator 184 are respectively provided with a month window 1831 and a day window 1841. The month indicator 183 is moveable within a range of the month-label area 181 and one of the numbers 1-12 on the month-label area 181 is selected by the month window 1831. The day indicator 184 is moveable within a range of the day-label area 182 and one of the numbers 1-31 on the day-label area 182 is selected by the day window 1841. Thereby users can respectively move the month indicator 183 and the day indicator 184 to select one of the numbers 1-12 and one of the numbers 1-31 by the month window 1831 and the day window 1841 correspondingly. Therefore, either the date at which food or an object is mounted into the sealed container or expiration date of the food or the object in the sealed container is labelled.

As shown in FIG. 7-10, in a preferred embodiment of the present invention, the lid 1 is fastened tightly on a top of a container body 3 for closing an opening 31 of the container body 3. A circular deformable airtight ring 10 is integrally formed on a surface 19 of the lid 1 and the surface 19 is in contact with an end surface 32 on the top of the container body 3 correspondingly. The circular deformable airtight ring 10 features on deformation generated while being squeezed by a force applied. The circular deformable airtight ring 10 is a circular angular ring with angular protrusions projecting from the lid 1 toward the end surface of the container body 3.

During a process of fastening the lid 1 with the container body 3, a pressure acted on the circular deformable airtight ring 10 being contacted with and squeezed by the end surface 32 is getting larger along with the fastening of the lid 1 because that the circular deformable airtight ring 10 is corresponding to the end surface 32. This causes deformation of the circular deformable airtight ring 10 so that the deformed circular deformable airtight ring 10 is closely attached to the end surface 32 to form a seal. Thereby air outside is blocked and unable to enter internal space of the container body 3.

By the design of the circular deformable airtight ring 10, a seal is formed while the lid 1 is fastened on and connected to the container body 3. There is no need to add a sealing washer. Thus cost is effectively reduced and product competitiveness is improved.

In a preferred embodiment, the surface of the lid 1 is provided with a plurality of circular deformable airtight rings 10 to form multiple isolation and prevent entrance of air outside. In the embodiment shown in FIG. 7-10, there are five circular deformable airtight rings 10 arranged at the surface of the lid 1.

In a preferred embodiment, the circular deformable airtight ring 10 is provided with a plurality of angular protrusions 101, each of which further has an angle ranging from 30 to 60 degrees.

After being tested, the sealed container of the present invention provides an excellent seal which is able to extend food shelf life.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalent.

What is claimed is:

1. A sealed container lid, comprising:

a lid; and a moisture absorbing block disposed on the lid;

wherein an open mounting recess is formed at a lower surface of an end surface of the lid, wherein the moisture absorbing block is a one-piece block and is mounted in the open mounting recess, wherein an elastic ring is mounted to a circumferential surface of the moisture absorbing block, and wherein at least one of an upper part and a lower part of the elastic ring is formed with a radially-projecting locking ring;

wherein a plurality of holding members are formed to project from a surface of a peripheral wall of the open mounting recess towards a center of the open mounting recess, wherein each of the plurality of holding members is a projecting piece, and wherein a locking portion is formed at an end of each of the plurality of holding members for projecting towards the center of the open mounting recess; and wherein a shallow slot is formed at an upper surface of the end surface of the lid for being covered by a cover plate, wherein a humidity-sensitive color-changing material is mounted in a space defined by the shallow slot and the cover plate, wherein a plurality of holes are penetratingly formed through the end surface of the lid to correspond in position to the shallow slot, and thereby the open mounting recess communicates with the shallow slot through the plurality of holes.

2. The sealed container lid as claimed in claim 1, wherein a date label member is mounted to the upper surface of the end surface of the lid.

3. The sealed container lid as claimed in claim 2, wherein the date label member includes a month-label area, a day-label area, a month indicator, and a day indicator; the month-label area and the day-label area are, respectively, marked with numbers 1-12 and numbers 1-31; the month indicator and the day indicator are, respectively, provided with a month window and a day window; the month indicator is moveable within a range of the month-label area and one of the numbers 1-12 on the month-label area is selected by the month window; the day indicator is moveable within a range of the day-label area and one of the numbers 1-31 on the day-label area is selected by the day window; thereby a date on which food or objects are mounted into a container body or an expiration date of the food or the objects in the container body is labelled.

4. The sealed container lid as claimed in claim 1, wherein at least one circular deformable airtight ring is integrally formed on a surface of the lid to correspond in position to and for being in contact with an end surface of a container body, and wherein when the lid and the container body are fastened with each other, the at least one circular deformable airtight ring is deformed responsive to pressure generated during fastening to thereby be securely attached to the end surface of the container body for forming a sealed attachment.

* * * * *